US007330680B2

(12) United States Patent
Bryant et al.

(10) Patent No.: US 7,330,680 B2
(45) Date of Patent: Feb. 12, 2008

(54) DRUM SUPPORT BUSHING WITH ORIENTING FEATURES

(75) Inventors: Donn Duane Bryant, Lexington, KY (US); Tom E Stickler, Pawleys Island, SC (US)

(73) Assignee: Lexmark International, Inc., Lexington, KY (US)

( * ) Notice: Subject to any disclaimer, the term of this patent is extended or adjusted under 35 U.S.C. 154(b) by 121 days.

(21) Appl. No.: 11/177,665

(22) Filed: Jul. 8, 2005

(65) Prior Publication Data

US 2007/0009286 A1 Jan. 11, 2007

(51) Int. Cl.
*G03G 15/00* (2006.01)

(52) U.S. Cl. ..... 399/117

(58) Field of Classification Search ..... 399/116, 399/117, 159, 167; 389/906; 29/898, 898.042, 29/898.054, 898.055, 898.057, 898.09; 384/297
See application file for complete search history.

(56) References Cited

U.S. PATENT DOCUMENTS 4,134,175 A 1/1979 Contoyanis
4,804,277 A 2/1989 Counoupas
5,052,090 A 10/1991 Kitaura et al.
5,052,885 A 10/1991 Foster
5,170,212 A * 12/1992 DeCecca ..... 399/103
5,402,207 A * 3/1995 Michlin ..... 399/117
5,511,885 A 4/1996 Coleman
5,541,710 A * 7/1996 Stewart et al. ..... 399/98
5,749,028 A 5/1998 Damji et al.
5,758,233 A * 5/1998 Coffey et al. ..... 399/111
5,815,773 A 9/1998 Zaman
5,875,378 A 2/1999 Campbell et al.
5,946,531 A 8/1999 Miura et al.
6,009,285 A 12/1999 Barry et al.
6,058,280 A * 5/2000 Kumar et al. ..... 399/117
6,246,841 B1 6/2001 Merrifield et al.
6,249,661 B1 6/2001 Saitoh et al.
6,266,503 B1 * 7/2001 Murayama et al. ..... 399/117
6,281,918 B1 8/2001 Burdick et al.
6,382,837 B1 5/2002 Olbrich et al.
6,394,660 B1 5/2002 Butler, III et al.
6,429,891 B1 8/2002 Chee et al.
6,481,915 B1 11/2002 Wyer
6,530,692 B2 * 3/2003 Wyer ..... 384/295
6,549,736 B2 4/2003 Miyabe et al.
6,580,888 B2 6/2003 Horrall et al.
6,615,006 B2 * 9/2003 Michlin et al. ..... 399/90
6,622,582 B1 9/2003 Boyatt, III et al.
6,659,680 B2 12/2003 Wyer
6,775,498 B2 8/2004 Palumbo et al.
6,871,031 B2 3/2005 Blaine et al.

(Continued)

FOREIGN PATENT DOCUMENTS

EP 668545 A2 * 8/1995

(Continued)

*Primary Examiner*—Robert Beatty
(74) *Attorney, Agent, or Firm*—Grossman, Tucker, Perreault & Pfleger, PLLC

(57) ABSTRACT

A photoconductive drum may be located and supported in an image forming apparatus via bushings at each end of a drum axle. The bushings may be produced from a single die cavity and may include orientation features which may be employed to key the bushings with a housing, such as a toner cartridge cleaner housing.

30 Claims, 10 Drawing Sheets

U.S. PATENT DOCUMENTS

2003/0210927 A1 11/2003 Stickler et al.
2005/0281594 A1* 12/2005 Kuma et al. ..... 399/299

FOREIGN PATENT DOCUMENTS

JP 05147753 A * 6/1993
JP 05312211 A * 11/1993
JP 08240220 A * 9/1996
JP 2002137489 A * 5/2002
JP 2005031488 A * 2/2005

* cited by examiner

DRUM SUPPORT BUSHING WITH ORIENTING FEATURES

FIELD OF THE INVENTION

This invention relates axle bushings suitable for use on a drum in an image forming apparatus. The bushings may be located on an end of the axle and may be molded from a single die and may include orientation features.

BACKGROUND OF THE INVENTION

Electrophotographic toner cartridges of the unitary type may include a developer section and a photoconductor or cleaner section connected to one another so that the developer roller, of the developer, may be pressed against the photoconductor drum, of the photoconductor, with a predetermined and controlled pressure. The controlled pressure may often be provided by permanently installed springs stretching between the two units such that the two units are not separable, thereby forming a unitary or one piece replaceable cartridge.

Such one piece toner cartridges may have the advantage of having the springs installed at the factory manufacturing the cartridge. Since the springs may have a relatively short operational life, the entire cartridge may be factory refurbished (or discarded) upon depletion of the toner supply whereupon new springs may be installed.

Two piece cartridges are also known in which the developer housing, of the toner, may be separated from the photoconductor or cleaner housing. When such two piece cartridges are installed in a typical printing device, they may be manually brought together, by the user, and interconnected by a latching mechanism, such as a resilient latch, lever, or springs of some sort, whereby the two units may be drawn together with the required pressure between the developer roll and the photoconductor roll for satisfactory imaging. The removable cartridge may include a photoconductive (PC) drum rotatably supported in the cleaner housing and a developer roller rotatably supported in the developer housing, which is slidably received in the cleaner housing. The developer roll may transfer toner from the developer housing to the photoconductive drum when both are rotating to print a latent image on a recording medium.

SUMMARY OF THE INVENTION

In a first exemplary embodiment the present invention relates to a pair of bushings for a photoconductive drum containing an axle to engage with a housing. The bushings include a hole formed therein to receive the axle and the bushings are capable of engaging with end sections of the axle. An orientation feature is provided that is capable of engaging with a corresponding orientation feature in the housing so that the bushings are keyed to said housing. The bushings containing the orientation feature may be formed from a common die cavity.

In another exemplary embodiment the present invention relates to a removable cartridge for use in an imaging forming apparatus. The apparatus includes a housing wherein the housing has opposing side walls, each side wall including an opening to engage a bushing. A photoconductive drum including an axle is provided along with a pair of bushings containing an orientation feature formed from a common die cavity. Each of the bushings engage the axle and the orientation feature keys the bushing to the apparatus housing.

In another exemplary embodiment the present invention relates to an image forming apparatus comprising a photoconductive drum including an axle, a pair of bushings formed from a single cavity affixed to opposite ends of the axle, wherein each bushing formed with at least one orientation feature. The housing including a pair of opposing side walls each including an opening with a corresponding orientation feature to key the bushings to said housing.

In another exemplary embodiment the present invention relates to a method of forming a pair of bushings for a photoconductive drum. The method includes supplying a die cavity to form said bushings and forming each of the bushings in such die cavity. The bushings also include an orientation feature. One may then supply a photoconductive drum including an axle and engage the bushings with the axle. This may be followed by supplying a housing for the drum wherein the housing is capable of engaging with the bushings and the housing includes a corresponding orientation feature for the bushings in order to key the bushings to the housing.

BRIEF DESCRIPTION OF THE DRAWINGS

These and other objects, features and advantages of the present invention will become apparent to those skilled in the art upon reference to the following written description and accompanying drawings in which.

DETAILED DESCRIPTION

Figure 1:
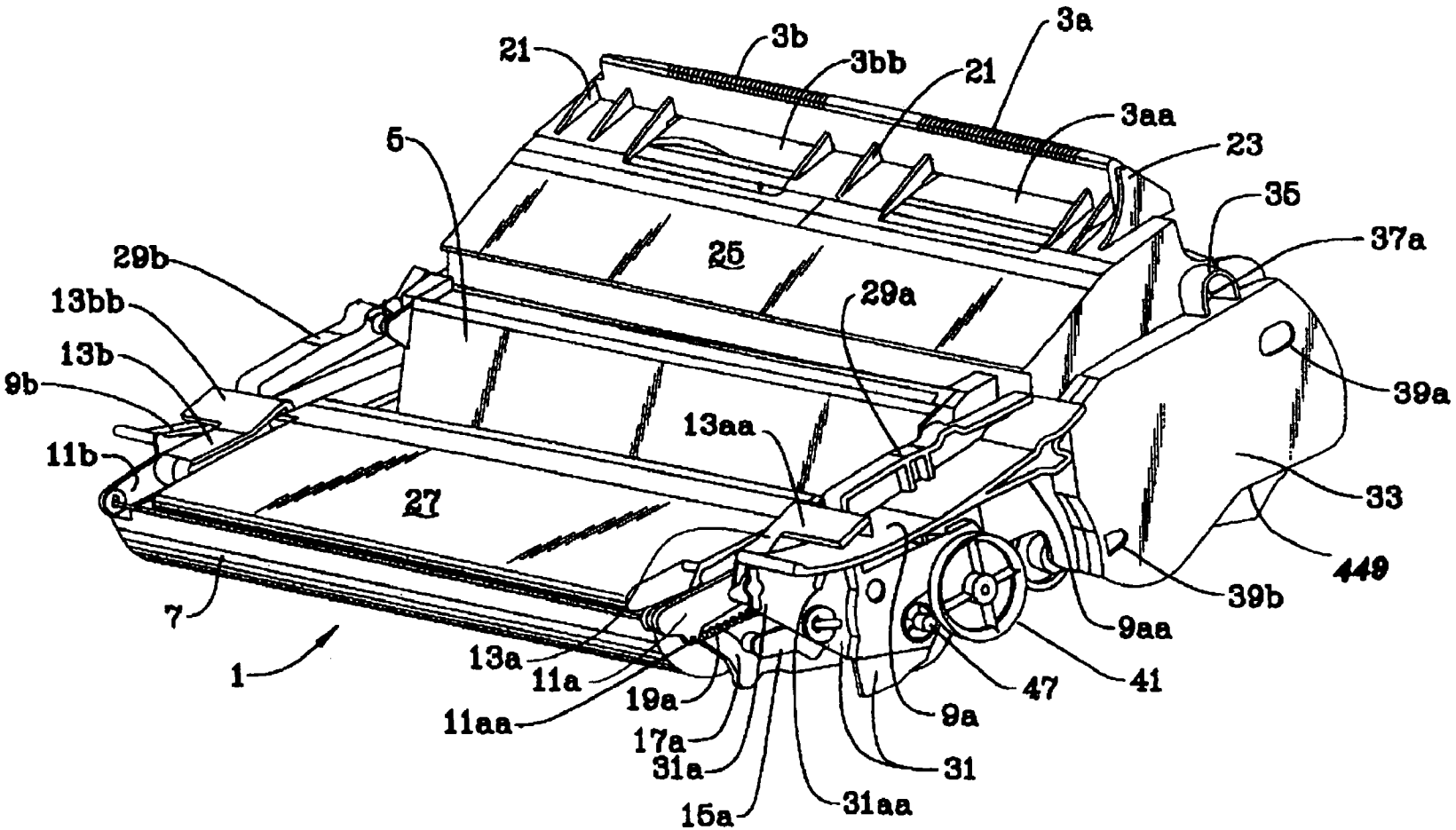
FIG. 1 is a perspective view of a toner cartridge from above and left rear, where left is determined facing the printer from its front side where cartridge insertion is made.

One example of a removable printer cartridge 1 is shown in FIG. 1 in a perspective view from above and left rear (the hand grips 3*a* and 3*b* being considered the front and the side having the pivoted upper shutter 5 being the upper side). For purposes of illustration, FIG. 1 shows the upper shutter 5 pivoted downward to its open position and lower shutter 7 pivoted rearward and upward to its open position. In actual operation, these positions may be reached by interaction with the printer or other device in which cartridge 1 is installed, as will be explained below.

To facilitate and guide insertion of cartridge 1 into the printer, cartridge 1 may have a left guide wing 9*a* and a right guide wing 9*b*. Guide wings 9*a* and 9*b* may be thin planes formed as arcs of a relatively large circle, except near the front, where the bottom 9*aa* may be enlarged downward.

Guide wings 9*a* and 9*b* may be mirror images of each other except that the left guide wing 9*a* may be wider (extends further laterally) than the right guide wing 9*b* simply to accommodate the width provided by a particular printer in which the exemplary cartridge 1 may be installed.

When cartridge 1 is installed in the printer, actuator surfaces 13*aa* and 13*bb* may be pushed downward by the mating surfaces of the printer to the positions above wings 9*a*, 9*b* respectively, as shown in FIG. 1. Cartridge 1 may be inserted by a human operator grasping grips 3*a*, 3*b* through holes 3*aa*, 3*bb* and moving cartridge 1 in the direction of shutter 5 and toward the rear of the printer (291, FIG. 7) in which it may be being installed. A series of upwardly extending ribs 21 spaced along the width of cartridge 1 under grips 3*a*, 3*b*, except at holes 3*aa* and 3*bb*, may provide strength while holes 3*aa* and 3*bb* provide room for the fingers of a person to grasp grips 3*a*, 3*b*. On the left side a relatively wide, upwardly extending tab 23 may be located. In an exemplary printer the top of tab 23 may interact with a physical sensing switch in the printer to detect that a cartridge 1 has been installed.

Front cover 25, on which grips 3*a*, 3*b*, ribs 21 and tab 23 may be integrally formed, may be located above a separated toner hopper. The top cover of cleaner housing 27 may be located rearward of shutter 5.

Immediately inside wings 9*a* and 9*b*, raised elongated locator surfaces 29*a*, 29*b* may be located to which pressure may be applied by a printer to firmly position the toning mechanisms of cartridge 1 when cartridge 1 is installed. Locator surfaces 29*a* and 29*b*, wings 9*a* and 9*b*, as well as rear cover 31 under wing 9*a*, may be formed integral with cleaner housing 27. Front cover 25, having grips 3*a*, 3*b* and an outer cover 33 on the left side and generally coextensive in length with the length of front cover 25 may also be integrally formed with the cleaner housing. Cover 33 may have a U-shaped housing 35 at its top. Housing 35 may trap spacer stud 37*a* and an assembly hole 39*a* near the upper front of cover 33 and a spring-holding hole 39*b* near the lower front of cover 33.

A coupler 41 may receive a drive element from a printer which contains an Oldham coupler to rotatably drive the developer roller 43 (not shown in FIG. 1) and toner adder roller 45 (not shown in FIG. 1). To the rear of coupler 41 the shaft 47 of photoconductor drum 49 may be located (drum not shown in FIG. 1).

Figure 2:
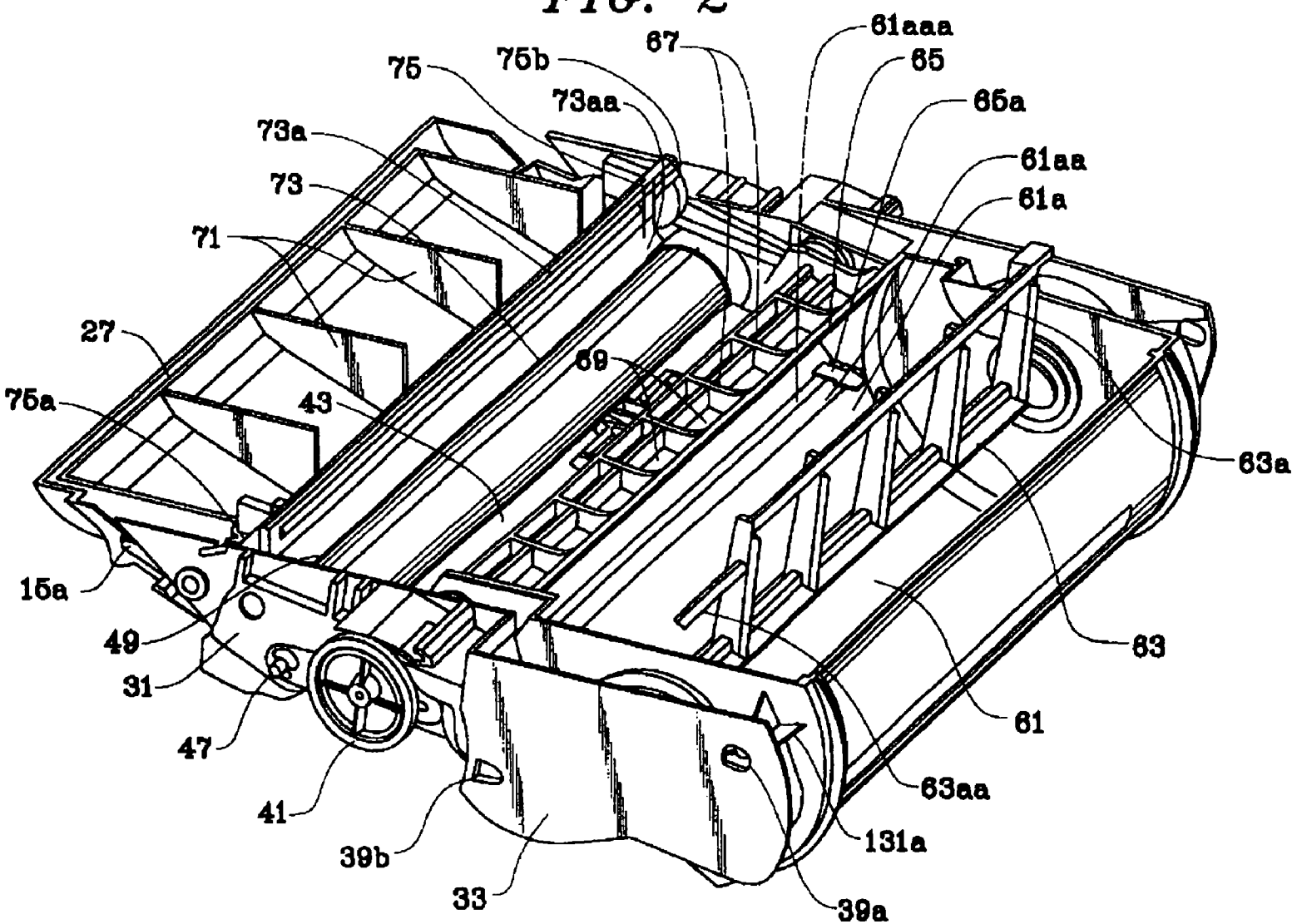
FIG. 2 is a perspective view from above and left front of the cartridge sectioned near the top.

FIG. 2 is a perspective view from above and left front of exemplary cartridge 1 sectioned near the top to show internal elements. At the immediate front a large, cylindrical toner hopper 61 may be located, having a paddle 63, which, during operation, may be rotated clockwise. Paddle 63 may have an outer toner moving bar 63*a*, which may extend across the width of hopper 61 except for a far left section 63*aa* which may be inset. The rear wall 61*a* of hopper 61 when cartridge 1 is installed for operation in a printer may terminate at about one-third of the total height of hopper 61 as a flat surface 61*aa*.

In FIG. 2, a small part of developer roller 43 to which coupler 41 may be directly attached, is seen past ribs 67. Developer roller 43 may be parallel to and in contact with photoconductor drum 49. Cleaner housing 27 (see FIG. 1) may have spaced, vertical internal baffles 71, which are strengthening members, as well as members which limit unbalanced accumulation of toner in housing 27. Toner which is not transferred during development may be scraped from photoconductor drum 49 by cleaning blade 73, which is mounted to a vertical panel 73*a*, having a horizontal gusset 73*aa* to increase strength.

Figure 3:
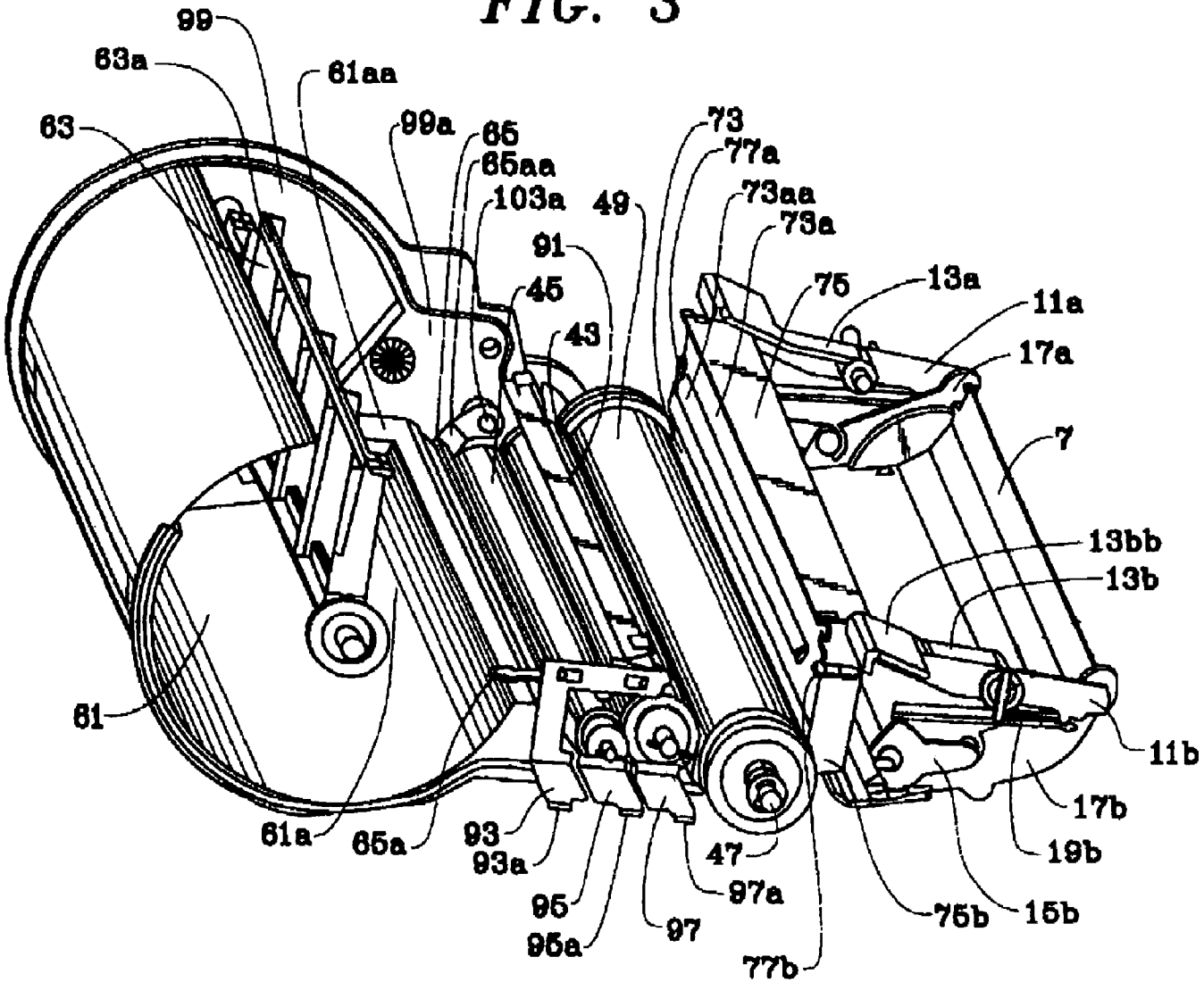
FIG. 3 is a top right front view of the cartridge with further cover elements removed.

FIG. 3 is a top right side view with further cover elements removed and part of the cleaner housing removed to illustrate the internal configuration of exemplary cartridge 1. A solid, steel-bar doctor blade 91 may extend parallel with and in pressure contact with developer roller 43. Blade 91 may contact roller 43 at about 20 degrees from the vertical toward toner adder roller 45. Also shown in FIG. 3 are metal electrical contact 93 to doctor blade 91, metal electrical contact 95 to toner adder roller 45 and metal electrical contact 97 to developer roller 43. The outer ends 93*a*, 95*a*, 97*a* of the contacts may bear against metal contacts in the printer when cartridge 1 is installed to receive electrical potential from the printer.

The toner adder roller 45 may be a conductive sponge material attached to a steel shaft and developer roller 43 may be a semiconductive material attached to a steel shaft. When cartridge 1 is installed for operation in a printer, cartridge 1 may be oriented generally as shown in FIG. 3 and the horizontal plane containing the lowest surface of toner adder roller 45 may preferably be above the lowest point of hopper 61.

Toner adder roller 45 and developer roller 43 may be journaled in the rearward extensions 99*a* and 101*a* (FIG. 4) of the end members 99 and 101 (FIG. 4) of hopper 61. Agitator 65 may have a bent portion 65*aa* to become parallel to extension 99*a* where it is pivoted to extension 99*a* on pin 103*a*. As paddle 63 rotates, bar 63*a* may contact extension 65*a*, thereby rotating agitator 65 around pin 103*a* upward. Agitator 65 may then return to near rear wall 61*a* under the force of gravity to dislodge toner, which otherwise tends to accumulate on exit surface 61*aaa* (see FIG. 2).

Figure 4:
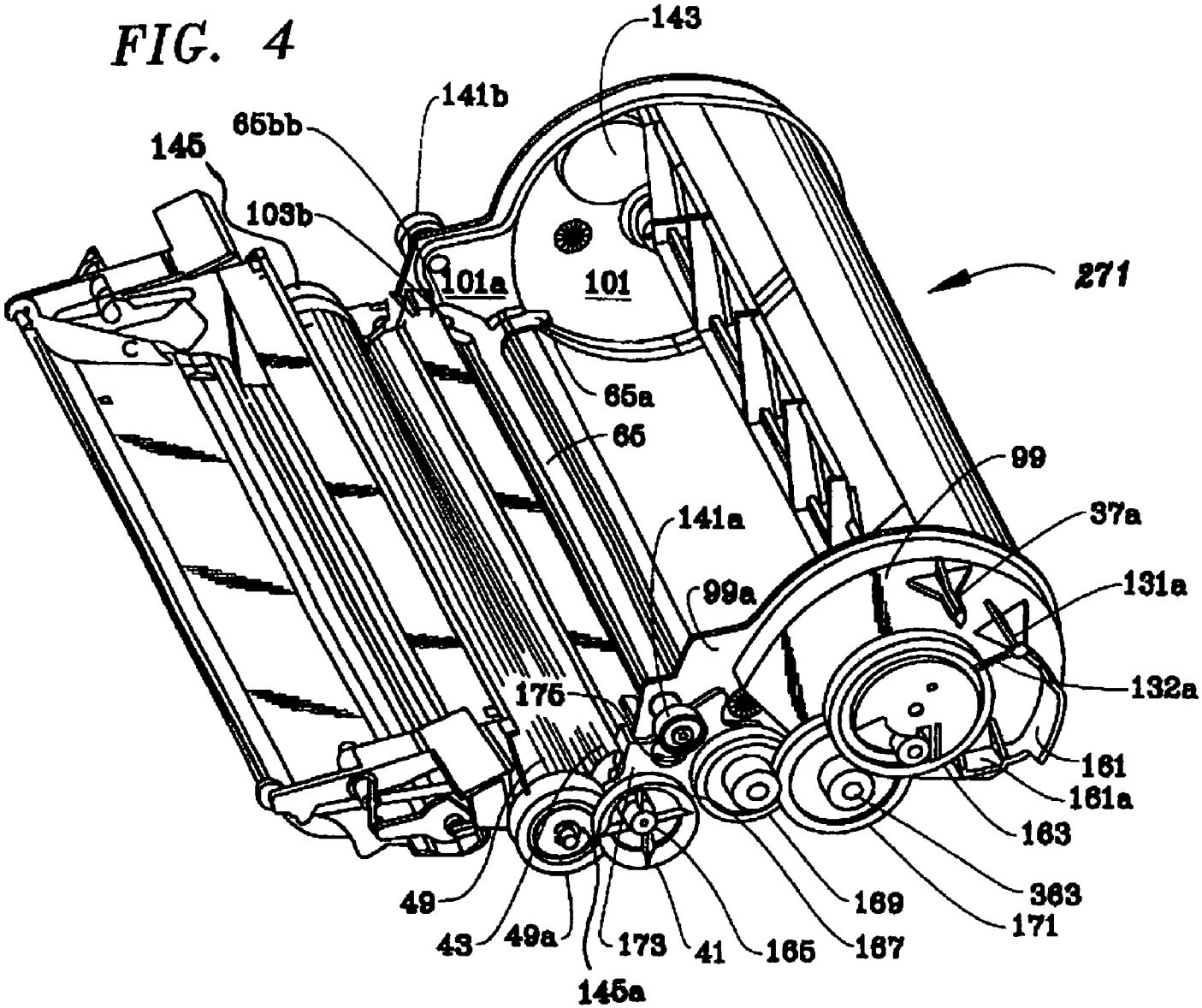
FIG. 4 is a top left rear view of the cartridge with cover elements removed.

FIG. 4 is a top left rear view with cover elements removed showing more fully the outside of members 99 and 99*a* of hopper 61. A spacer stud 37*a* may be supplied that may be integral with end member 99. Under and to the front of stud 37*a* spring mounting post 131*a* may be located, which mounts one end of spring 132*a*, the other end of which is mounted in a hole in member 39*b* (FIG. 2), which is an inner extension of cover 33 (FIG. 2).

Also integral with end member 99 a perpendicular shield wall 161 may be located, which may extend downward and rearward to a barrier to physically protect torsional paddle gear assembly 163. The bottom portion of wall 161 may form a flat contact surface 161*a* to receive a locating roller from the printer when cartridge 1 is installed.

Gear 49*a*, which may be integral with the end of photoconductor drum 49, may receive power from a meshing gear in the printer when cartridge 1 is installed in the printer. Coupler 41 may be integral with developer roller 43 and may drive idler gear 165, which may drive toner adder roller 45 (FIG. 3) by being meshed with gear 167, which may be integral with toner adder roller 45. Coupler 41 may receive power from a driver in the printer which may be separate from the drive to drum 49, although preferably from a single motor in the printer.

Figure 5:
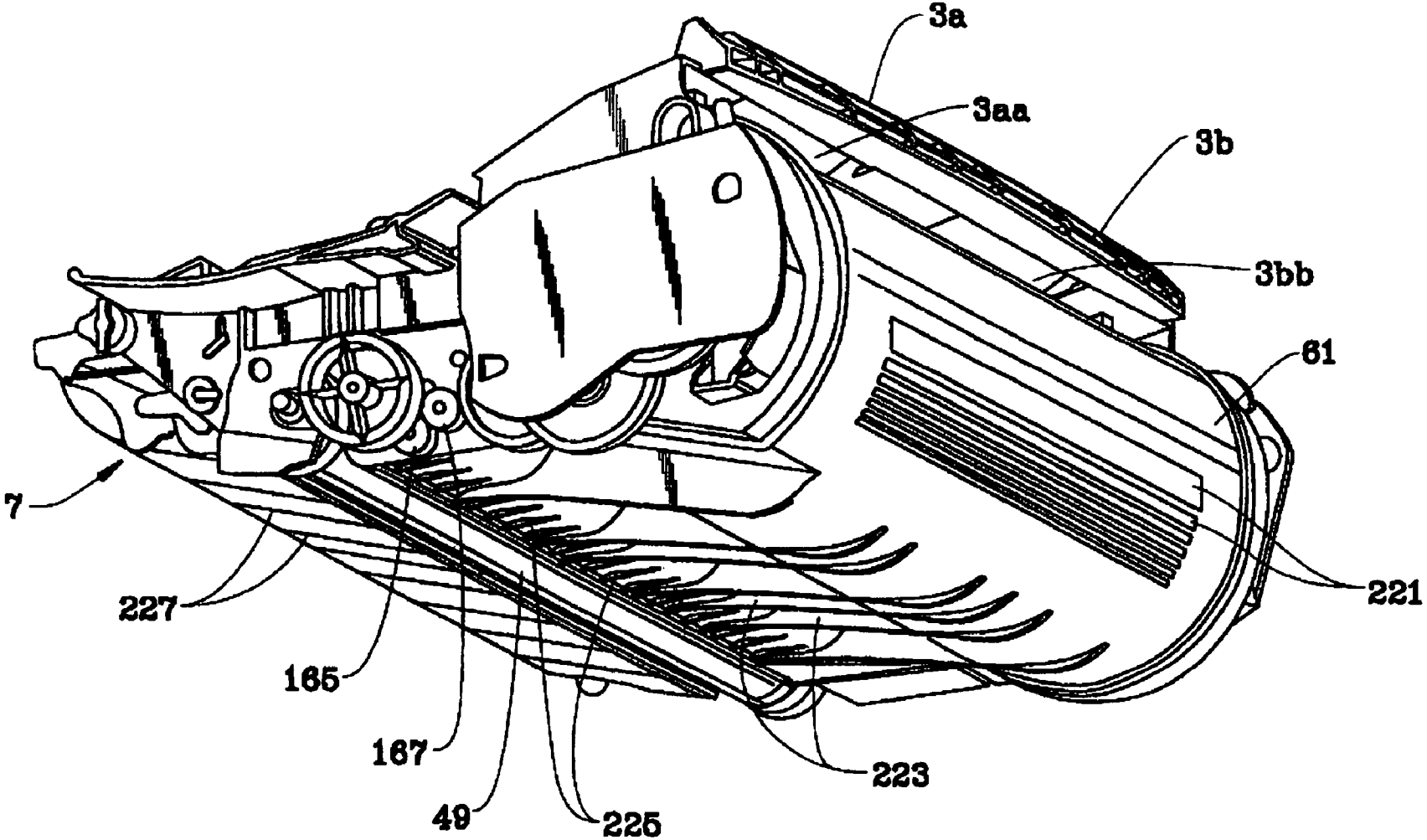
FIG. 5 is a bottom left front view of the cartridge.

FIG. 5 is a bottom left front depiction of exemplary cartridge 1 viewed externally. A series of horizontal depressions 221 along the back of hopper 61 may provide a roughened surface for thumbs when fingers grasp the cartridge through opening 3*aa* and 3*bb*. A series of relatively long vertical ribs 223 may be integral with the bottom of hopper 61 to serve as paper and other media guides, while a series of shorter ribs 225, located rearward of the start of ribs 223 and between ribs 223, may prevent media snags as media encounter photoconductor drum 49, located immediately after ribs 223 and 225. Past drum 49, media may encounter further media guide ribs 227 located on the bottom of shutter 7. FIG. 5 also affords a clear view of idler gear 165 and gear 167.

Figure 6:
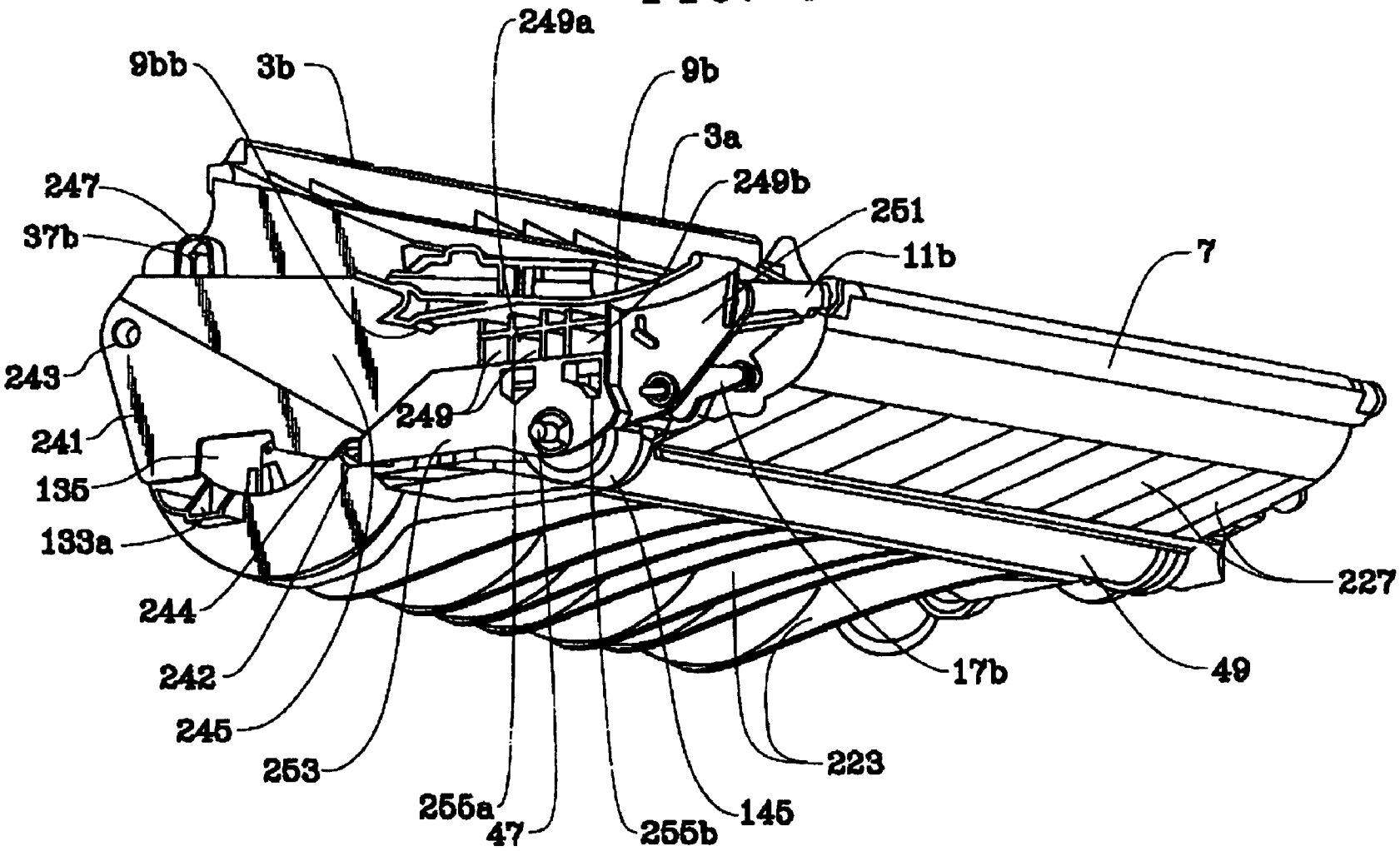
FIG. 6 is a bottom right rear view of the cartridge.

FIG. 6 is a bottom right rear depiction of cartridge 1 viewed externally. This shows the full right guide wing 9*b* with enlarged front part 9*bb*. FIG. 6 also shows the right cover element. A front lower cover section 241 may cover much of the encoder wheel 135 and may have an access hole 243 for ease of assembly as well as an access opening 244. Cover section 241 may be stepped outward a small amount to provide room for spring 132*b* (FIG. 4) to extend between post 131*b* and hole 242 (best seen in FIG. 6). Generally, above and forward of and integral with cover section 241 cover section 245 may be located, which is over the remaining upper front of cartridge 1. Section 245 may have a U-shaped housing 247 at its top which may trap spacer stud 37*b*. In the rearward part of section 245 opposite the area above photoconductor drum 49, rectangular channels 249 may be located with the second rectangular channel 249*a* and the last rectangular channel 249*b* being open to pass air for cooling photoconductor drum 49 during operation of cartridge 1.

The far rear portion 251 may mount links 11*b* and 17*b* to shutter 7. A bottom section 253 of the cover located under and forward of passages 249*a* and 249*b* may mount the shaft 47 of photoconductor drum 49 and have two upper symmetrical vent holes 255*a* and 255*b* to pass air for cooling drum 49.

As shown in FIG. 4, the housing 271 and its attached end members 99 and 101, may form toner hopper 61. Extension 101*a* may journal toner adder roller 45 and developer roller 43. Gear plate 173, which may be attached to extension 99*a* by screw 175, may journal the opposite ends of toner adder roller 45 and developer roller 43. Accordingly, a single unitary assembly, such as a developer housing, may be formed of the hopper 61 rearward to and including developer roller 43.

Front cover 25 grips 3*a*, 3*b*, left outer cover 33, rear wall 31, (FIG. 1) right cover sections 241, 245, and 251, (FIG. 6) wings 9*a*, 9*b* and cleaner housing 27 may be a single molded part. Photoconductor 49 may be journaled in this part with its shaft 47 extending past the covers on opposite sides. Shutter 7 may be movably supported to left cover 31 and right rear cover 251. Accordingly, a single unitary assembly may be formed of the cover members, the photoconductor drum 49 and the shutter 7.

The photoconductor drum 49 may be installed into the cleaner housing assembly 27 by placing the drum and the two gears 49*a* and 145 (see FIG. 4) in position with a thin washer, (not shown) on the left side and inserting shaft 47 through that assembly and journaled openings in the housings 31 (FIG. 2) and 253 (FIG. 6). Standard E-clips may be installed on each end of shaft 47 to hold the drum and shaft from lateral movement. Hub 145*a* (and its counterpart on the opposite end of the drum 49) may be inserted inside drum 49. Shaft 47 may then be threaded through gear 145, drum 49 and then through gear 49*a*.

Figure 7:
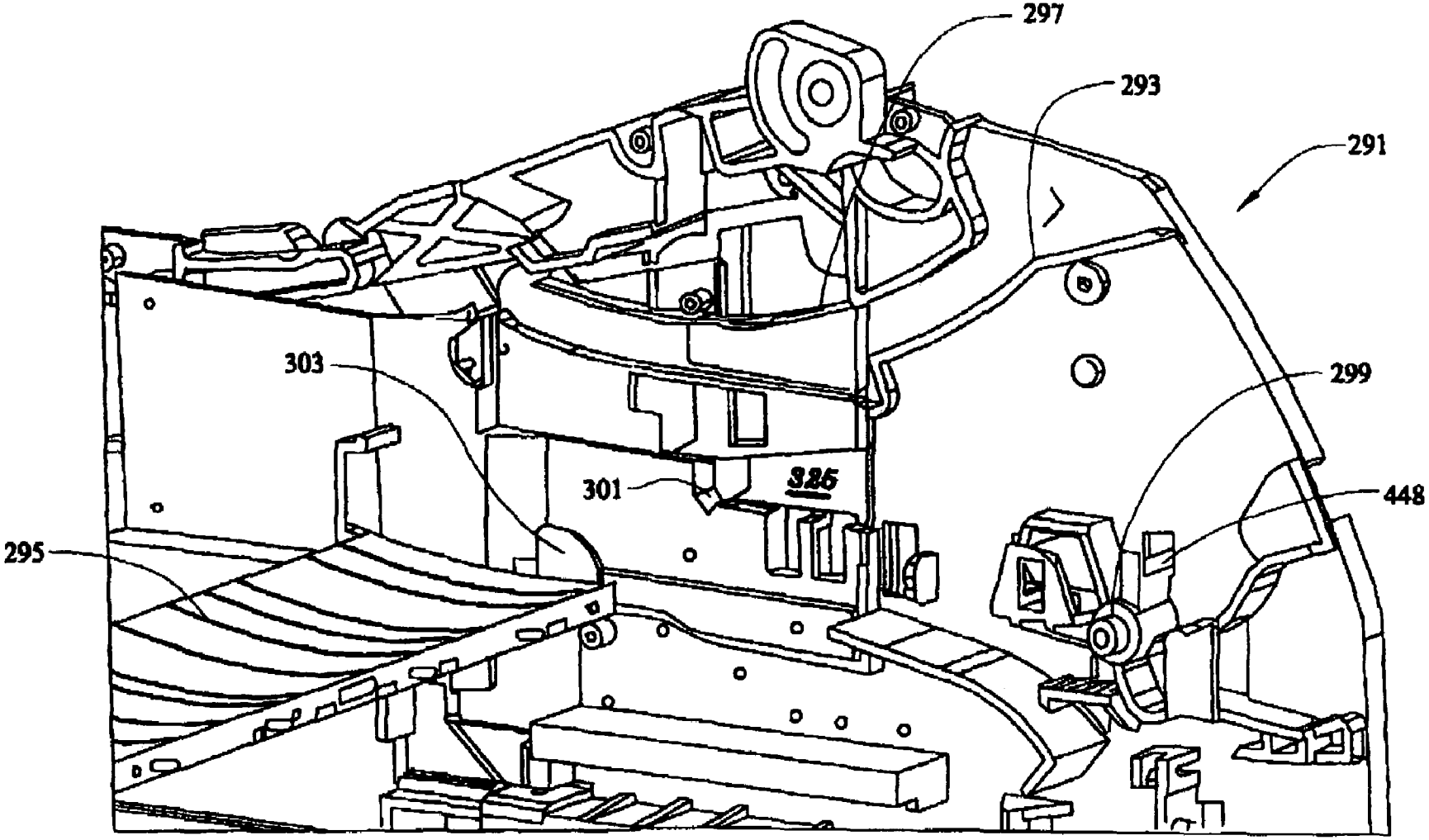
FIG. 7 is a left front view of the inside of a printer in which the cartridge is installed.

FIG. 7 is a left front view of the inside of a printer with which the exemplary cartridge herein described may be used. The cartridge 1 is installed in a printer 291 (FIG. 7) from the front to a final position well within the printer 291. To achieve this, guide wings 9*a* and 9*b* (FIG. 1) may be initially guided by a lower track 293 over a curved track, which guides cartridge 1 under the laser printhead (not shown) and over paper feed elements 295.

The path may be downward, which may utilize gravity while inserting cartridge 1, thereby easing insertion. The guide 293 (and a guide not shown, which is a mirror image of guide 293 on the opposite side of printer 291) has the same curvature as wings 9*a*, 9*b* so that the wings 9*a*, 9*b* can follow guide 293 and its opposite guide.

Upper guide 297 may be parallel to guide 293. Guide 297 may extend further into the printer than guide 293. A guide (not shown), which is a mirror image of guide 297, may be located on the opposite side of printer 291. Guide 297 may encounter actuator surface 13*bb* (FIG. 1) early during the insertion of cartridge 1. As cartridge 1 is moved rearward, actuator surface 13*bb* may be rotated to open shutter 7 (as surface 13*aa* may be rotated by encountering a mirror image of guide 297 on the left side of the printer). This early movement of shutter 7 may be very advantageous in that it may eliminate the need for space and mechanism which would be required if actuation occurred at the end of insertion of cartridge 1.

Also shown in FIG. 7 is the right reference position roller 299 on which contact surface 133*a* may rest when the cartridge is inserted. Contact surface 161*a* (FIG. 4) may rest on an identical roller (not shown) on the opposite side of printer 291. Rearward of roller 299 is V-block 301, shown more clearly in FIG. 8, and an associated electrical contact 302. Further rearward is an upstanding lug 303, which may contact shutter 7 to hold it open.

Figure 8:
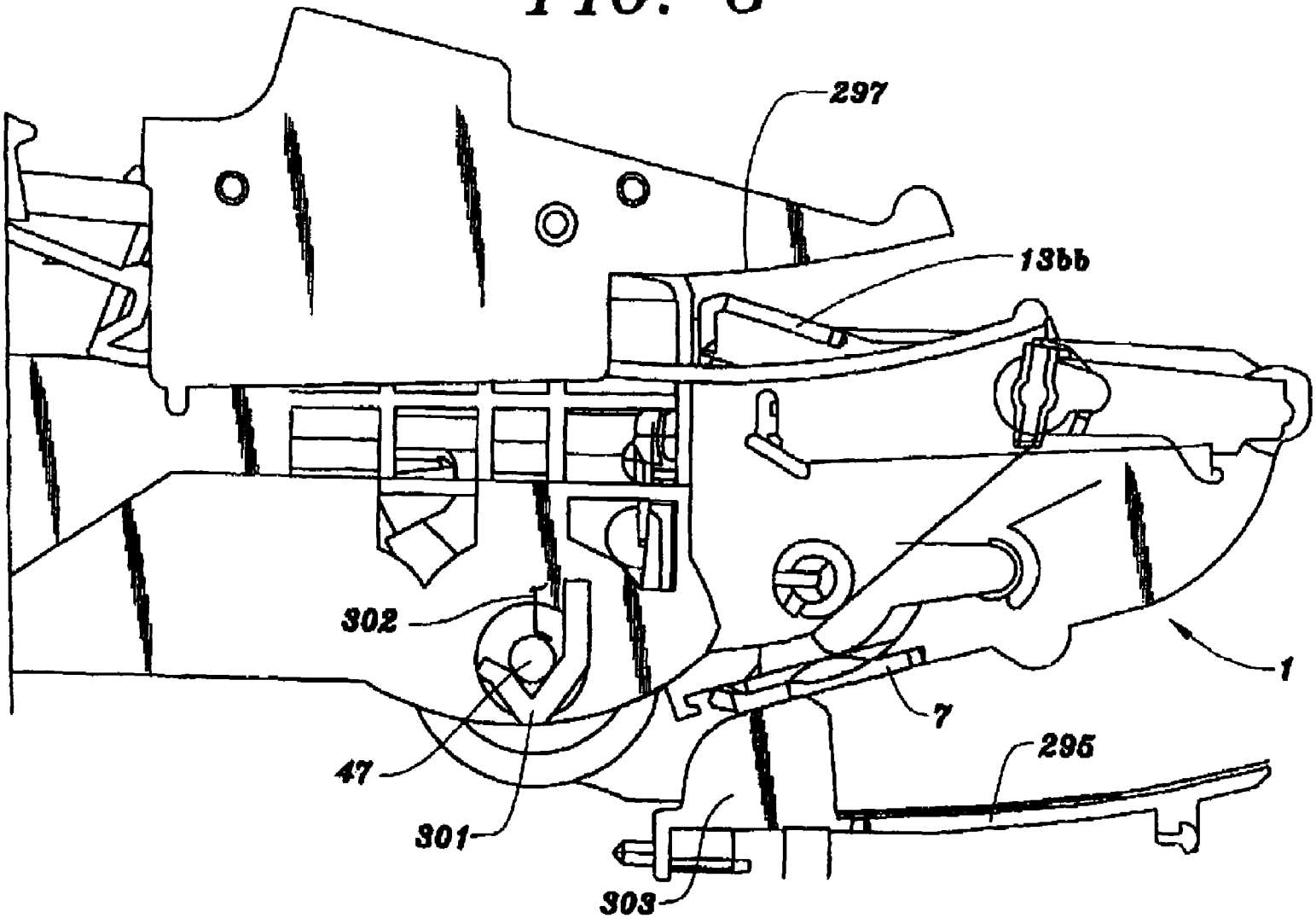
FIG. 8 is a partially sectioned right side view showing more detail of parts shown in FIG. 7 with the cartridge installed.

As cartridge 1 is inserted, wings 9*a*, 9*b* may be guided by guides 293 and 297 and the mirror image guide (not shown) on the opposite side of printer 291. As insertion continues, the wings 9*a*, 9*b* may fall off the lower guide 293 (and its mirror image guide) and the shaft 47 of photoconductor drum 49 may drop into V-block 301 and a mirror image V-block (not shown) on the opposite side of printer 291. A depending thin metal sheet 302 (FIG. 8, shown in side view) may be contacted and bent somewhat by shaft 47 as it is guided by V-block 301. This may create a connection for operating potential to shaft 47. When cartridge 1 falls into V-block 301, lug 303 may contact shutter 7 to hold shutter 7 open. Accordingly, to remove the cartridge, it may be grasped by grips 3*a*, 3*b* and may be pulled sharply upward and forward. Wings 9*a* and 9*b* may again enter between guides 293 and 297, and the cartridge may be pulled free.

Figure 9:
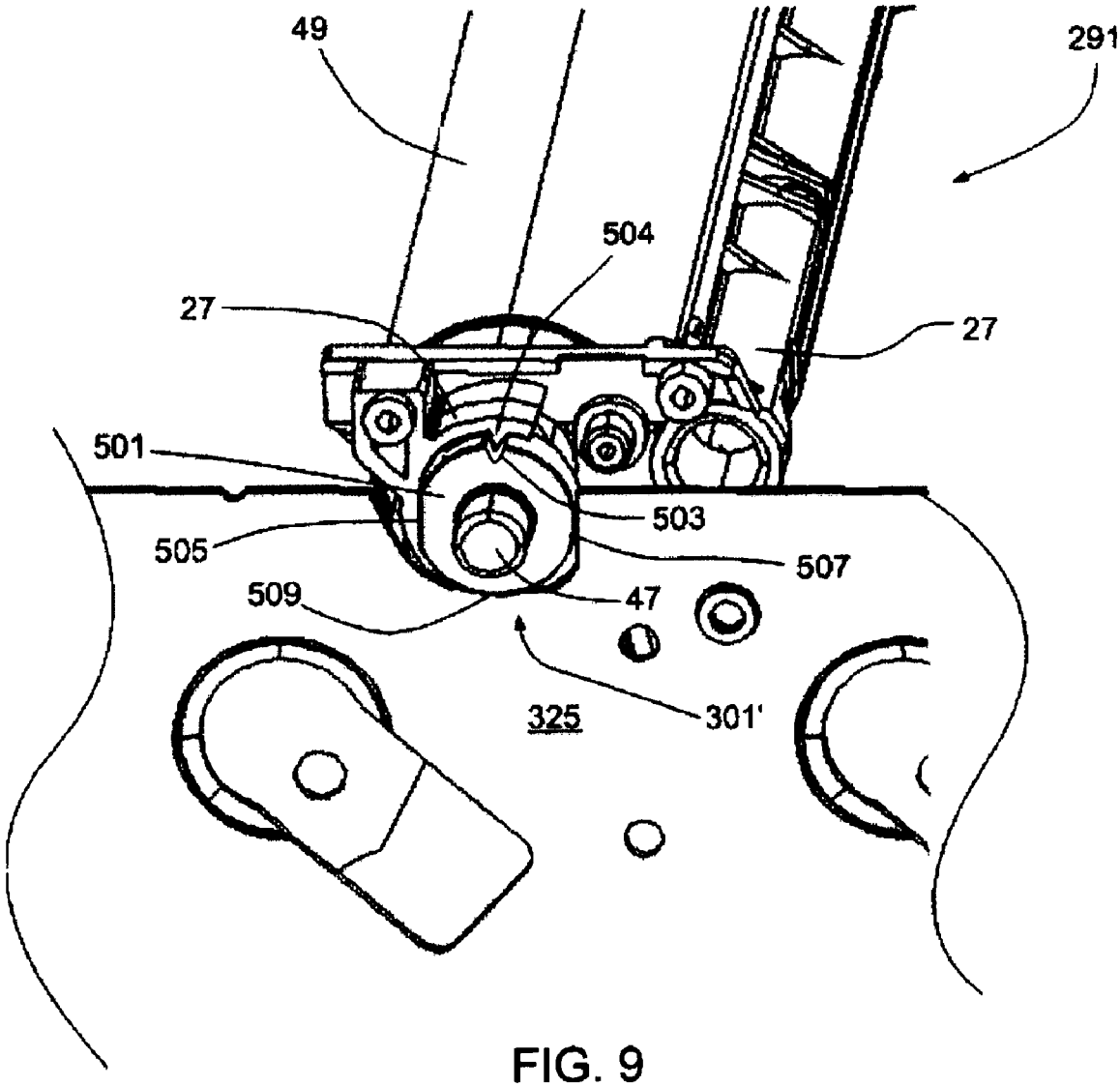
FIG. 9 is a partially sectioned side view showing more details of the bushing of the present invention, with the cartridge installed in the printer frame.

With reference to FIG. 9, a bushing 501 may be provided on each end of the PC drum axle 47. The bushing may have a desired inner surface geometry, e.g. relatively concentric inner surfaces to accommodate an end of the axle 47. Therefore, the bushing may engage housing 27, which, as previously described (see FIG. 1) may serve as the cleaner housing for a printer cartridge. As illustrated (FIG. 9) the bushing 501 may also serve to strategically position the PC drum 49 within the cleaner housing 27. For example, the bushing may include one or more orientation features. The orientation feature(s) may assume the shape of a notch 503 in the outer surface of the bushing. The orientation feature may also assume the geometry such as a flat section 505. Accordingly, in the context of the present invention a variety of geometrical feature(s) may be employed any of which may serve to orient the bushing 501 in a desired manner when engaging the cleaner housing 27.

With attention again directed to FIG. 9 the orientation feature(s) of the bushing may therefore engage with the cleaner housing so that the bushing may be keyed to the cleaner housing. By use of the term keyed it may be understood that the bushings may engage the housing in only one manner, such that a pair of bushings may engage with the housing in only one orientation on each side of the housing.

In that sense the cleaner housing may supply one or more corresponding geometric features to accommodate and engage with the notch 503 or flat section 505. As illustrated in FIG. 9, it can be seen that the cleaner housing may supply a protruding geometric feature 504 to engage with the notch 503 in addition to supplying a flat surface to accommodate flat surface 505.

It should be appreciated that in the context of bushings that may be employed herein, and owing to the typical manufacture of bushings that typically relies upon some form of molding, the inner bore of the bushing may not be formed such that it is concentric with the outer surface, which outer surface may interface with the printer. In the absence of orientation features on the outer surface, as noted above, the positional error of the inner bore that may be present may then supply a random orientation from one end of the PC drum to the other end of the PC drum. This may then result in that the centerline of the PC drum is not relatively parallel to a desired location. This may also lead to print errors from one side of a printed page to another side of the printed page. For example, in a multi-color printer, such positional errors may also result in location error in the distance from one cartridge to the next, thereby resulting in what may be described as color plane overlay errors.

It can therefore be appreciated that in the context of the present invention the bushings, supplied with an orientation feature, may be prepared from a corresponding common die cavity that forms the bushing and accompanying orientation feature. In such manner, and to the extent that there are any positional errors in a die cavity, all parts produced from a single die cavity may have a relatively similar and a relatively consistent positional error (when engaging with, e.g., the shaft of the PC drum via use of the orientation feature). Accordingly, bushings so produced from a single die cavity may supply the result that when assembled with the PC drum and placed in a housing, such as a cleaner housing, the positional errors that may be present may now be relatively similar on both ends of such drum. This therefore may maintain a centerline of the PC drum in a relatively more parallel configuration to the centerline of the location features in the printer. In addition, in the present invention, the spacing from one cartridge to another may now be more precise.

Figure 10:
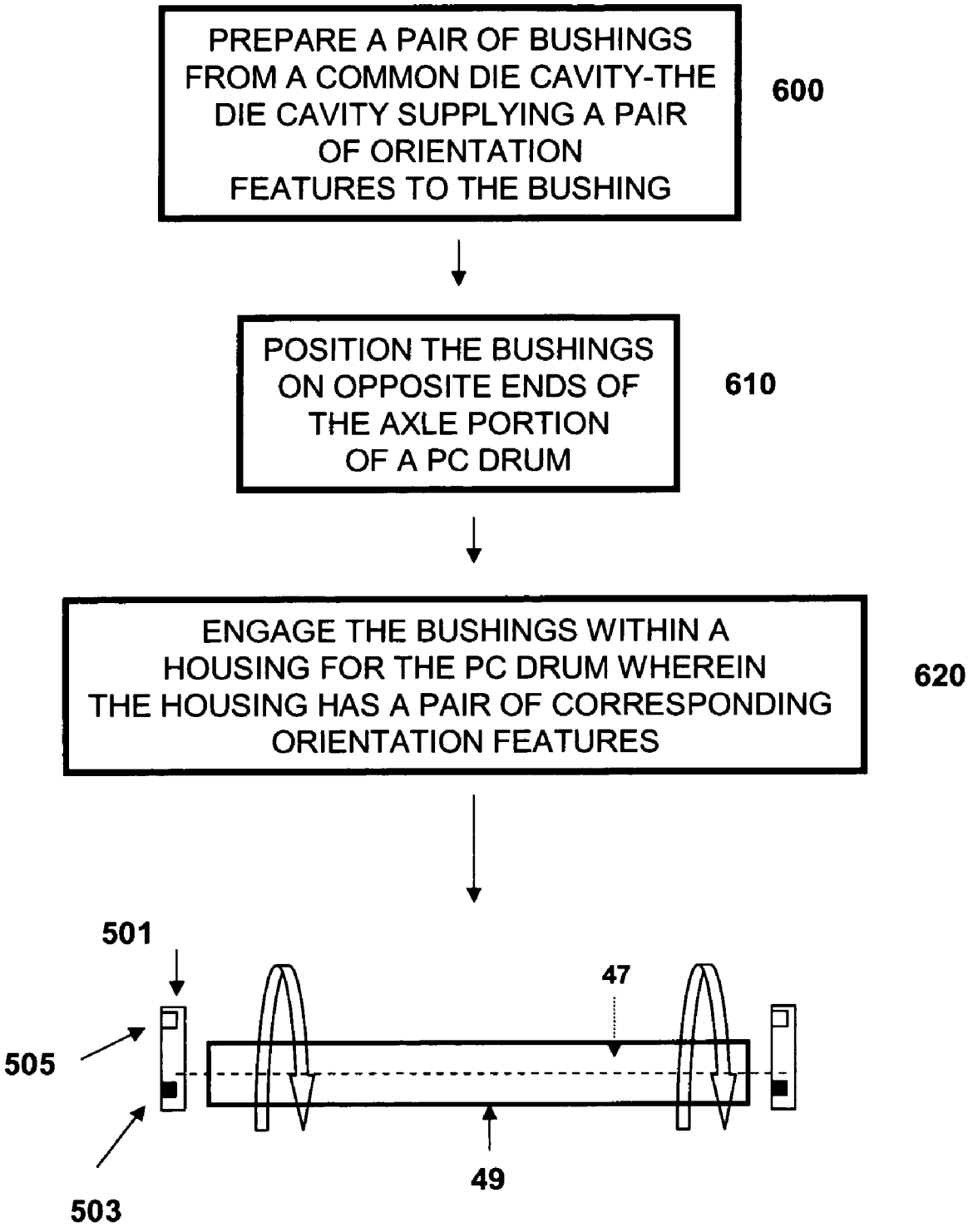
FIG. 10 is an exemplary flow chart illustrating one approach for producing a bushing in accordance with the present invention.

With attention to FIG. 10, an illustrative embodiment of the present invention begins at 600 with the preparation of bushings from a common die cavity, wherein the die cavity may supply a pair of orientation features 503 to the bushing. The bushings may then be positioned and engaged at 610 to opposite ends of the axle portion of a PC drum. The bushings may then be engaged to the PC drum housing at 620 wherein the housing similarly contains a pair of corresponding orientation features. For purposes of clarity in this illustration, the housing is not shown.

In such manner it can be appreciated that the bushings may be keyed to the housing. As illustrated at the bottom of FIG. 10, any positional errors that may exist within the inner bore of the bushing may now be relatively similar on both sides of the drum. In FIG. 10, as one example of a positional error, the inner bore of the bushing is illustrated as having a relatively off-center support for the axle 47. As illustrated, when the bushings are sourced from a single die cavity, and the bushings 501 include orientation features 503 that may serve to key the bushing to the housing, the off-center support for the axle 47 may now be relatively the same on both sides of the drum.

The bushings herein may be prepared from sintered molding techniques, in particular, a sintered bronze bearing containing the aforementioned orientation features. Such molding techniques may also be understood as a form of powder metallurgy. For example, the sintered bronze bushing may be prepared by compacting metal powder grains in a compression type mold to a final desired shape. This may lead to what may be described as a compacted form of the bushing, which may then be heated to additionally heat to fuse the metal grains. Such resulting sintered part may then be compacted to a final desired size to achieve target bushing dimensions. In addition, it should be appreciated that other metallic bushings may be employed, such as oil impregnated stainless steel.

Molded plastic bushings may also be employed. In addition, one may sort the molded plastic bushings so that bushings from a single mold cavity may be similarly employed. For example, a pair of bushing may be provided from a multi-cavity injection molding machine, wherein the pair of bushings that may be applied to at both ends of the axle for a given PC drum are those that are sourced from a single die cavity within the multi-cavity mold. The molded plastic may be a thermoplastic or thermoset type material. The plastic may also be one having relatively high wear characteristics, such as carbon or graphite-filled thermoplastics or thermosets. Suitable polymer materials would therefore include, e.g. polyethylene terephthalate (PET), polyetheretherketone (PEEK), polyimide (PI) or fluorocarbon polymer (PTFE, etc.) Additives which may improve wear resistance, hardness, lubricity and deflection may also be included in any selected plastic formulation.

In addition to the keying of the bushing to the housing as described above, it should be appreciated that the bushing may further engage with a "V-block" 301' in the frame 325 of the printer 291. More specifically, the bushing may engage within the V-block by one or more contacting surfaces 507 and 509. Other geometric shapes other than a "V-block" may be employed to engage the bushing 501. This may therefore provide a method to maintain a centerline of the drum relatively parallel between the V-block 301' and the corresponding V-block on the other side of the printer.

The present invention may be carried out in other ways than those specifically disclosed herein without departing from the spirit and scope of the invention. The present invention is not limited to the type of printer disclosed herein and is also applicable to other various printer embodiments. The present embodiments are therefore to be considered in all respects as illustrative and not restrictive.

What is claimed is:

1. A pair of bushings for a photoconductive drum containing an axle to engage with a housing, said bushings comprising:

a hole formed therein to receive said axle, the bushings capable of engaging with end sections of said axle;

an orientation feature on said bushings capable of engaging with corresponding location features in said housing so that said bushings are keyed to said housing;

wherein said pair of bushings containing said orientation feature are formed from a common die cavity wherein said bushings, when engaged to said axle of said photoconductive drum, position said axle parallel to said location features in said housing.

2. The bushings of claim 1 wherein said orientation feature comprises two geometrical features on each of said bushings.

3. The bushings of claim 1 wherein said bushings comprise metallic bushings.

4. The bushings of claim 1 wherein said bushings comprise bronze bushings.

5. The bushings of claim 1 wherein said bushings comprise plastic bushings.

6. The bushings of claim 1 wherein said orientation feature comprises a notch in said bushing.

7. The bushings of claim 1 wherein said bushings have an outer circumferential surface and said orientation feature comprises a relatively flat surface as a portion of said outer surface.

8. The bushings of claim 1 wherein said common die cavity is part of multi-cavity mold.

9. A removable cartridge for use in an imaging forming apparatus, comprising:

a housing wherein said housing has opposing side walls, each side wall including an opening to engage a bushing, said housing including location features;

a photoconductive drum including an axle;

a pair of bushings containing an orientation feature formed from a common die cavity wherein each of said bushings engage said axle and said orientation feature keys said bushing to said housing, wherein said bushings, when engaged to said axle of said photoconductive drum, position said axle parallel to said location features in said housing.

10. The cartridge of claim 9 wherein said orientation feature comprises two geometrical features on each of said bushings.

11. The cartridge of claim 9 wherein said bushings comprise metallic bushings.

12. The cartridge of claim 9 wherein said bushings comprise bronze bushings.

13. The cartridge of claim 9 wherein said bushings comprise plastic bushings.

14. The cartridge of claim 9 wherein said orientation feature comprises a notch in each of said bushings.

15. The cartridge of claim 9 wherein said bushings have an outer circumferential surface and said orientation feature comprises a relatively flat surface as a portion of said outer surface.

16. The cartridge of claim 9 wherein said common die cavity is part of a multi-cavity mold.

17. The cartridge of claim 9 wherein said housing comprises a toner cartridge cleaner housing.

18. The cartridge of claim 9 wherein said bushing is capable of locating said housing and drum in an image forming apparatus.

19. An image forming apparatus, comprising;

a photoconductive drum including an axle;

a pair of bushings formed from a single die cavity affixed to opposite ends of said axle, each bushing formed with at least one orientation feature, a housing including a pair of opposing side walls each including an opening with a corresponding orientation feature to key said bushings to said housing, said housing including location features and wherein said bushings, when engaged to said axle of said photoconductive drum, position said axle parallel to said location features in said housing.

20. The image forming apparatus of claim 19 wherein said orientation feature comprises two geometrical features on each of said bushings.

21. The image forming apparatus of claim 19 wherein said bushings comprise metallic bushings.

22. The image forming apparatus of claim 19 wherein said bushings comprise bronze bushings.

23. The image forming apparatus of claim 19 wherein said bushings comprise plastic bushings.

24. The image forming apparatus of claim 19 wherein said orientation feature comprises a notch in each of said bushings.

25. The image forming apparatus of claim 19 wherein said bushings have an outer circumferential surface and said orientation feature comprises a relatively flat surface as a portion of said outer surface.

26. The image forming apparatus of claim 19 wherein said common die cavity is part of a multi-cavity mold.

27. The image forming apparatus of claim 19 wherein said housing comprises a toner cartridge cleaner housing.

28. The image forming apparatus of claim 19 wherein said bushing is capable of locating said housing and drum in an image forming apparatus.

29. A method for positioning a pair of bushings for a printer housing, said housing including location features, comprising:

supplying a common die cavity to form each of said pair of bushings;

forming each of said pair of bushings in said die cavity wherein said bushings include an orientation feature;

supplying said axle and engaging said bushings with said axle;

supplying a housing for said axle wherein said housing is capable of engaging with said bushings and said housing includes corresponding location features for said bushings to key said bushings to said housing; and engaging said bushings with said housing wherein said bushings, when engaged to a photoconductive drum axle, position said axle parallel to said housing location features.

30. The method of claim 29 wherein said die cavity is one cavity in a multi-cavity mold.

* * * * *